US008210760B2

(12) United States Patent
Sandahl et al.

(10) Patent No.: US 8,210,760 B2
(45) Date of Patent: Jul. 3, 2012

(54) DECK STAIN APPLICATOR

(75) Inventors: Jeffrey E. Sandahl, Buffalo, MN (US); Timothy Jon Wessels, Victoria, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 330 days.

(21) Appl. No.: 12/618,243

(22) Filed: Nov. 13, 2009

(65) Prior Publication Data

US 2011/0117284 A1 May 19, 2011

(51) Int. Cl.
*A46B 15/00* (2006.01)
*A46B 11/00* (2006.01)

(52) U.S. Cl. ..... 401/9; 401/140; 15/115

(58) Field of Classification Search ..... 401/9, 10, 401/137–140, 130, 261, 265, 266, 24, 25; 15/114, 115, 116.1, 116.2, 118, 160, DIG. 5
See application file for complete search history.

(56) References Cited

U.S. PATENT DOCUMENTS

| | | | | |
|---|---|---|---|---|
| 4,611,941 | A | 9/1986 | Karliner et al. | |
| 4,822,194 | A | 4/1989 | Simonette | |
| 4,845,799 | A * | 7/1989 | Amundson | 15/114 |
| 4,846,799 | A | 7/1989 | Tanaka et al. | |
| 4,954,001 | A * | 9/1990 | Billat | 401/139 |
| 6,178,581 | B1 * | 1/2001 | Lewis | 15/116.2 |
| 7,192,210 | B2 | 3/2007 | Svendsen et al. | |
| 7,325,990 | B2 | 2/2008 | Svendsen et al. | |
| 2007/0147943 | A1 | 6/2007 | Svendsen et al. | |
| 2009/0041529 | A1 | 2/2009 | Gallardo | |
| 2009/0100624 | A1 | 4/2009 | MacCormick | |
| 2011/0296638 | A1 * | 12/2011 | DeCarr | 15/118 |

FOREIGN PATENT DOCUMENTS

| | | | |
|---|---|---|---|
| GB | 2469476 | A | 10/2010 |
| WO | 2009/088539 | A1 | 7/2009 |
| WO | 2009/121857 | A1 | 10/2009 |
| WO | 2010127931 | A2 | 11/2010 |

OTHER PUBLICATIONS

Cuprinol Power Pad for Decking User Guide, 12 pages, Mar. 2009.
Cuprinol PowerPad for Decking, http://www.cuprinol.co.uk/products/pwerpad_for_decking_overview, 2009.

* cited by examiner

*Primary Examiner* — David Walczak
*Assistant Examiner* — Jennifer C Chiang
(74) *Attorney, Agent, or Firm* — Westman, Champlin & Kelly, P.A.

(57) ABSTRACT

The present disclosure generally relates to coating material applicators and more specifically, but not by limitation, to an apparatus for applying a coating material such as stain to a surface such as a deck, characterized by a generally planar surface with intentional gaps between elements (e.g., boards of a deck). In one example, a coating material applicator is provided. The coating material applicator is configured to apply a coating material to a structure having a generally planar surface formed by members having opposed surfaces separated by one or more gaps. The coating material applicator includes a base layer having an applicator surface for applying a coating material to the generally planar surface and a removable implement for applying the coating material to the opposed surfaces.

20 Claims, 10 Drawing Sheets

140
130
136
102
124
134
134
120
126
128
118
138
132

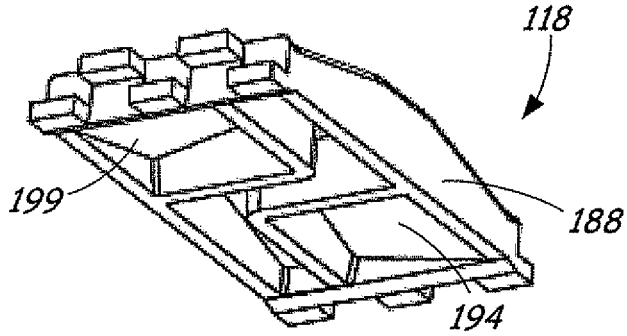
FIG. 8
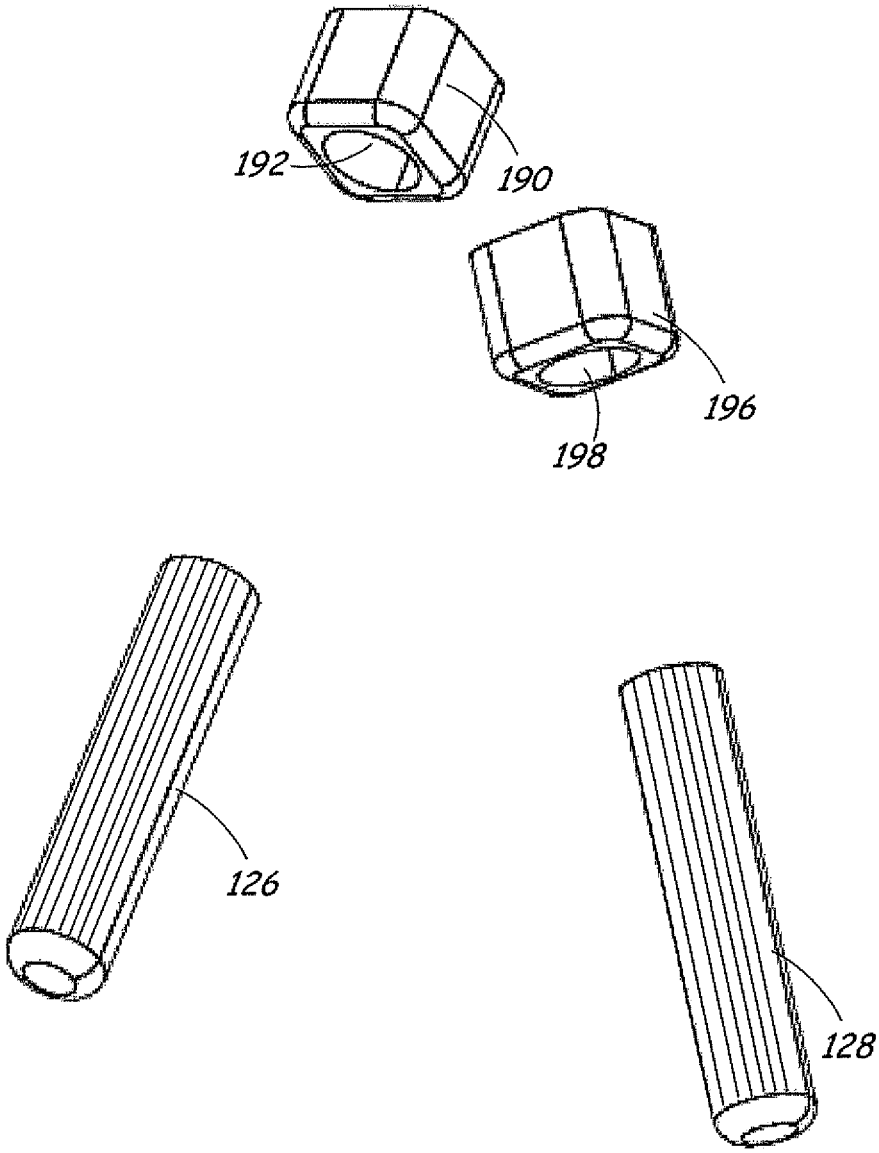

DECK STAIN APPLICATOR

BACKGROUND

The present disclosure generally relates to coating material applicators and more specifically, but not by limitation, to an apparatus for applying a coating material such as stain to a surface such as a deck, characterized by a generally planar surface with intentional gaps between elements (e.g., boards of a deck).

In the past, it has been difficult to apply stain to the opposed surfaces of the boards in the gaps of decks since pad type applicators have been preferred to apply the stain to the deck. Alternatively or in addition to the pad type applicator, a conventional brush has been known to be used to apply stain both to the planar surface and to the opposed surfaces in the gaps. Using a brush, however, has been found to be time consuming and awkward, necessitating stooping to reach the deck elements with the brush.

The discussion above is merely provided for general background information and is not intended to be used as an aid in determining the scope of the claimed subject matter.

SUMMARY

In one exemplary embodiment, a coating material applicator is provided. The coating material applicator is configured to apply a coating material to a structure having a generally planar surface formed by members having opposed surfaces separated by one or more gaps. The coating material applicator includes a base layer having an applicator surface for applying a coating material to the generally planar surface and a removable implement for applying the coating material to the opposed surfaces.

In one exemplary embodiment, a method of applying a coating material to a deck or deck-like structure is provided. The structure is of the type having members having opposed surfaces separated by one or more gaps. The method includes removably attaching a tool to an applicator head assembly and applying the coating material to a generally planar surface of the structure by delivering the coating material to an applicator surface of the applicator head assembly. The method also includes applying the coating material to the opposed surfaces using the tool.

These and various other features and advantages will be apparent from a reading of the following Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

FIG. 8 is an exploded view of a removable implement for a deck stain applicator, under one embodiment.

DETAILED DESCRIPTION

The present disclosure generally relates to coating material applicators and more specifically, but not by limitation, to an apparatus for applying a coating material to a surface such as a deck, characterized by a generally planar surface with intentional gaps between elements (e.g., boards of a deck). As used herein, the term "coating material" is meant to refer to liquid materials such as paints, varnishes, stains, and the like. In one example, a coating material comprises stains and preservatives, with or without pigment or tint, and similar liquid coating materials, whether for natural, synthetic, wood, and/or wood-like materials. Both penetrating and non-penetrating coating materials are to be understood to be within the meaning of "stain", as used herein. Further, as used herein the term "deck" is meant to refer to a structure having a generally planar surface with intentional gaps between elements (e.g., boards). While particular embodiments are described herein in the context of a deck stain applicator, the concepts described herein can be useful in other coating applications.

Figure 1:
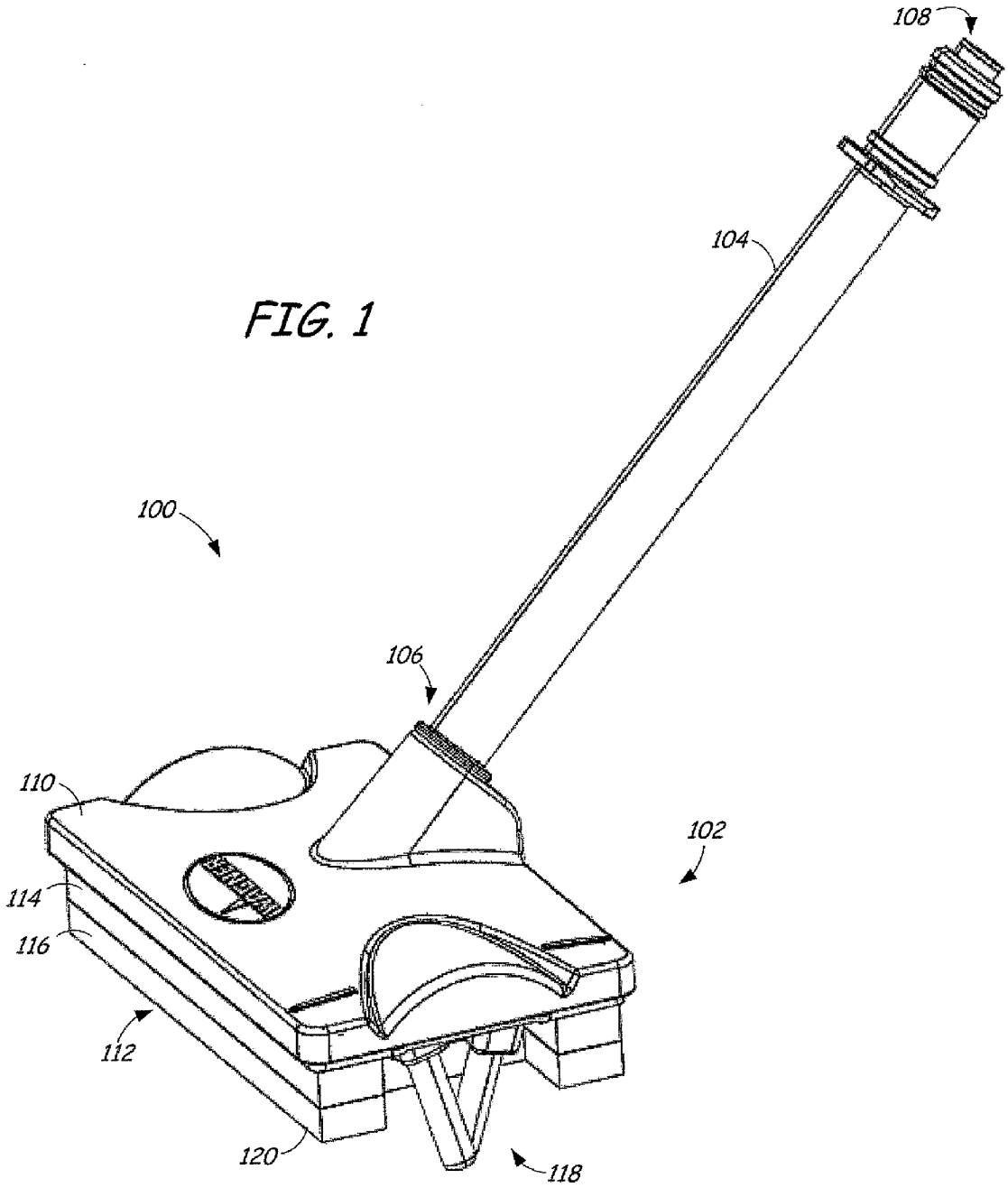
FIG. 1 is a perspective view of a deck stain applicator, under one embodiment.

FIG. 1 is a perspective view of a deck stain applicator 100, under one embodiment. As illustrated in FIG. 1, deck stain applicator 100 includes an applicator head assembly 102 connected to a shaft 104 at a connection 106. Shaft 104 is configured to be coupled to a source of coating material (illustratively stain) using a connection 108. In one embodiment, deck stain applicator 100 can be connected to an electrically powered device (e.g., powered by batteries) that, for example, provides stain from a reservoir. One example of a powered device is described in PCT Publication WO 2009/088539 (filed on Sep. 26, 2008 as application serial number PCT/US2008/077832). Deck stain applicator 100 can also be connected to a manually operated device having, for example, a trigger that is actuated by a user to provide stain from a reservoir.

In one embodiment, connection 106 comprises a rigid connection between shaft 104 and applicator head assembly 102. In another embodiment, connection 106 can comprise a flexible connection, such as a swivel connection. In one example, connection 106 enables applicator head assembly 102 to rotate with respect to shaft 104 about one or more axes.

As illustrated in FIG. 1, applicator head assembly 102 comprises a top cover 110 and a base plate assembly 112. Base plate assembly 112 includes a substantially planar applicator surface 120 that is configured to apply stain to a generally planer surface, such as a surface of a deck. Base plate assembly 112 can include multiple layers (illustratively a first base plate layer 114 and a second base plate layer 116) for delivering the stain to the applicator surface 120.

Applicator head assembly 102 also includes an implement, or tool, 118 that extends from the applicator head assembly 102. Implement 118 is configured to assist in the application of stain during use of applicator 100. For example, in one embodiment during application of stain to a deck or deck-like surface having a generally planar surface with intentional gaps between elements (i.e., boards), implement 118 extends beyond applicator surface 120 to apply the stain to opposed surfaces of the deck. For instance, implement 118 operates to apply stain to surfaces of adjacent boards, the surfaces being generally perpendicular to the deck surface coated by applicator surface 120.

Figure 2:
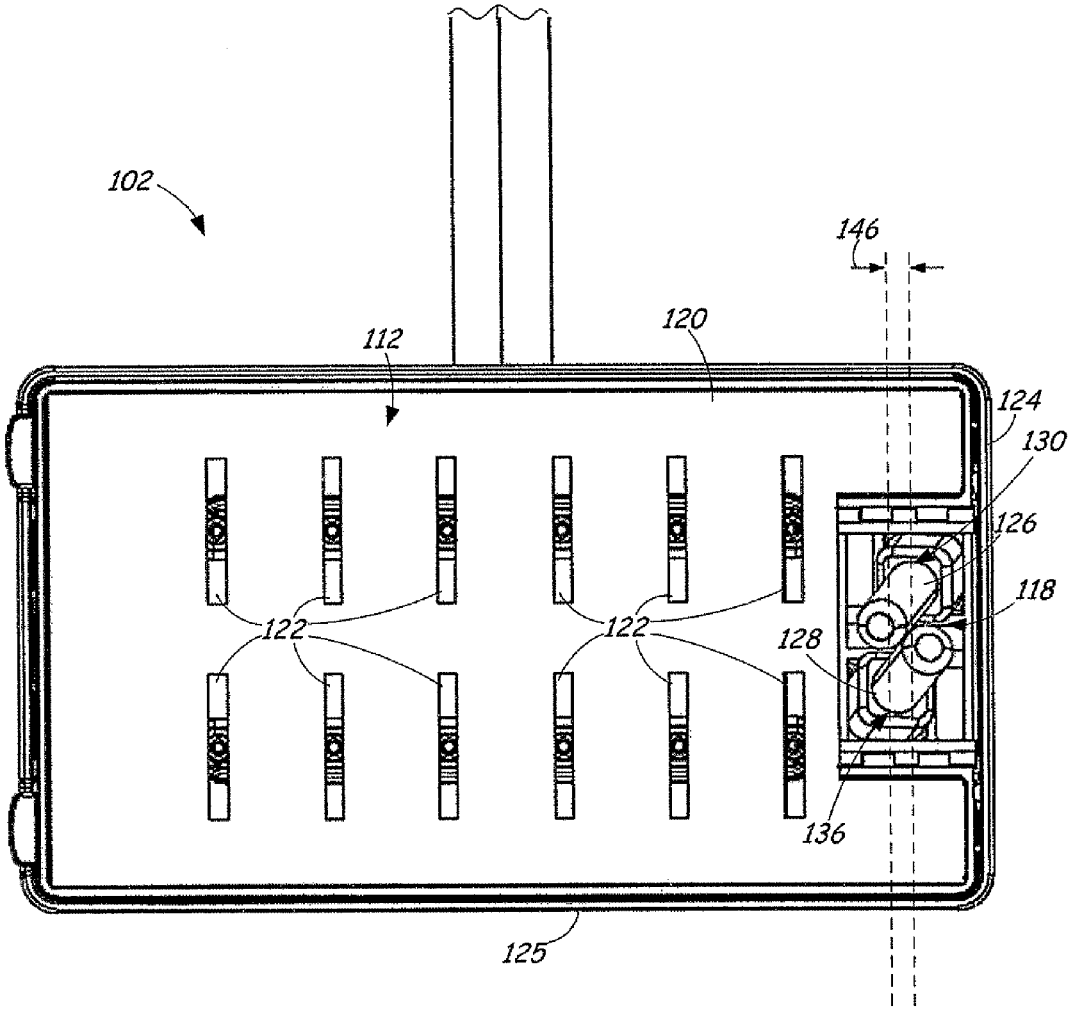
FIG. 2 is a bottom view of a deck stain applicator, under one embodiment.

FIG. 2 is a bottom view of applicator head assembly 102 illustrating applicator surface 120 of base plate assembly 112. Base plate assembly 112 comprises a plurality of orifices (illustratively holes or slots) 122 for delivering the coating material to the applicator surface 120. In one embodiment, applicator head assembly 102 can include an exposed nap layer or napped pad (not shown in FIG. 2) attached to surface 120. In one embodiment, a nap layer or napped pad is removably attached to head assembly 102 using an adhesive and/or a fastening mechanism (e.g., hook-and-loop type fasteners, clips, clamps, pins, buttons, etc.).

Figure 3A:
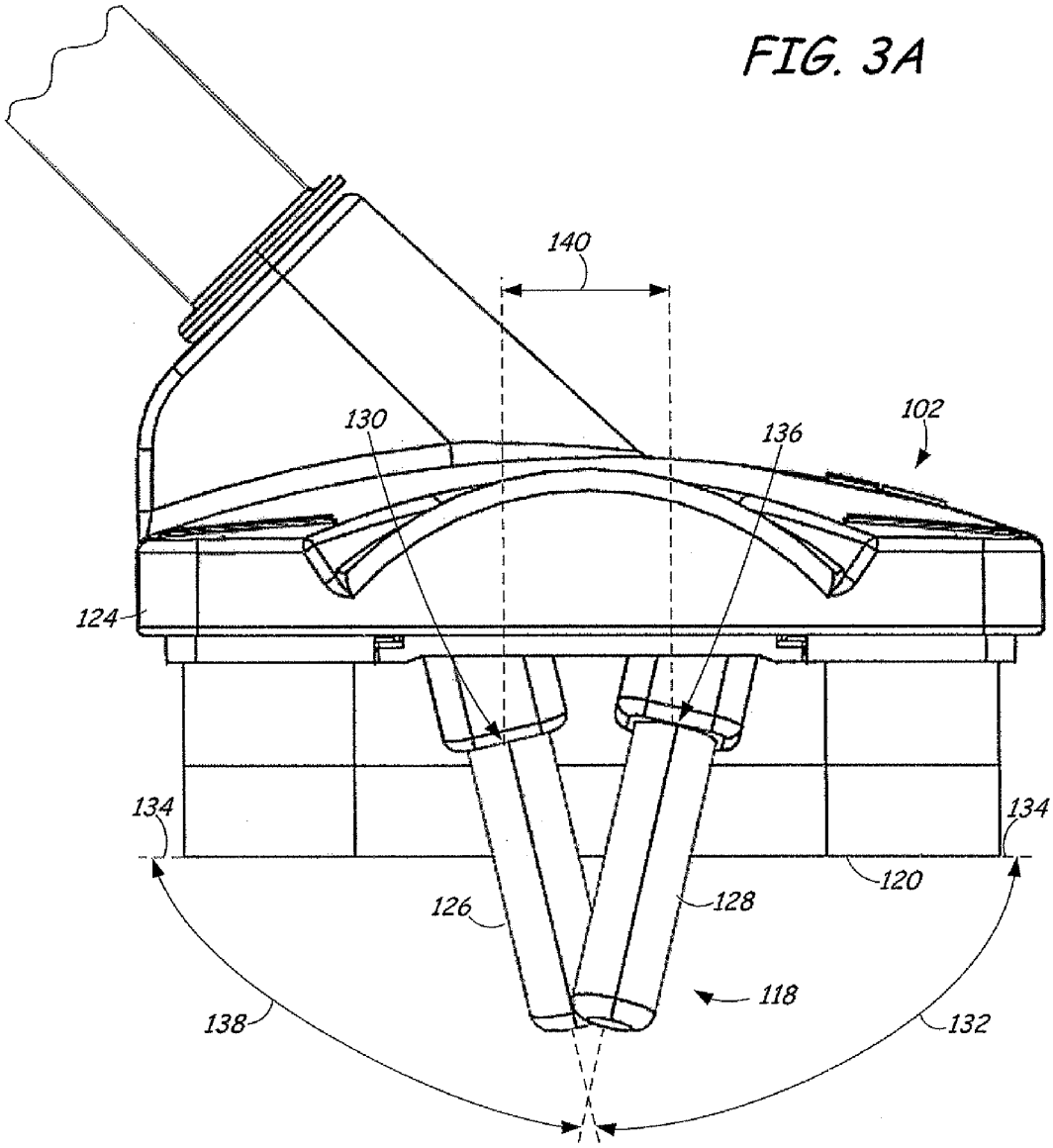
FIGS. 3A and 3B are side views of a deck stain applicator, under one embodiment.
Figure 3B:
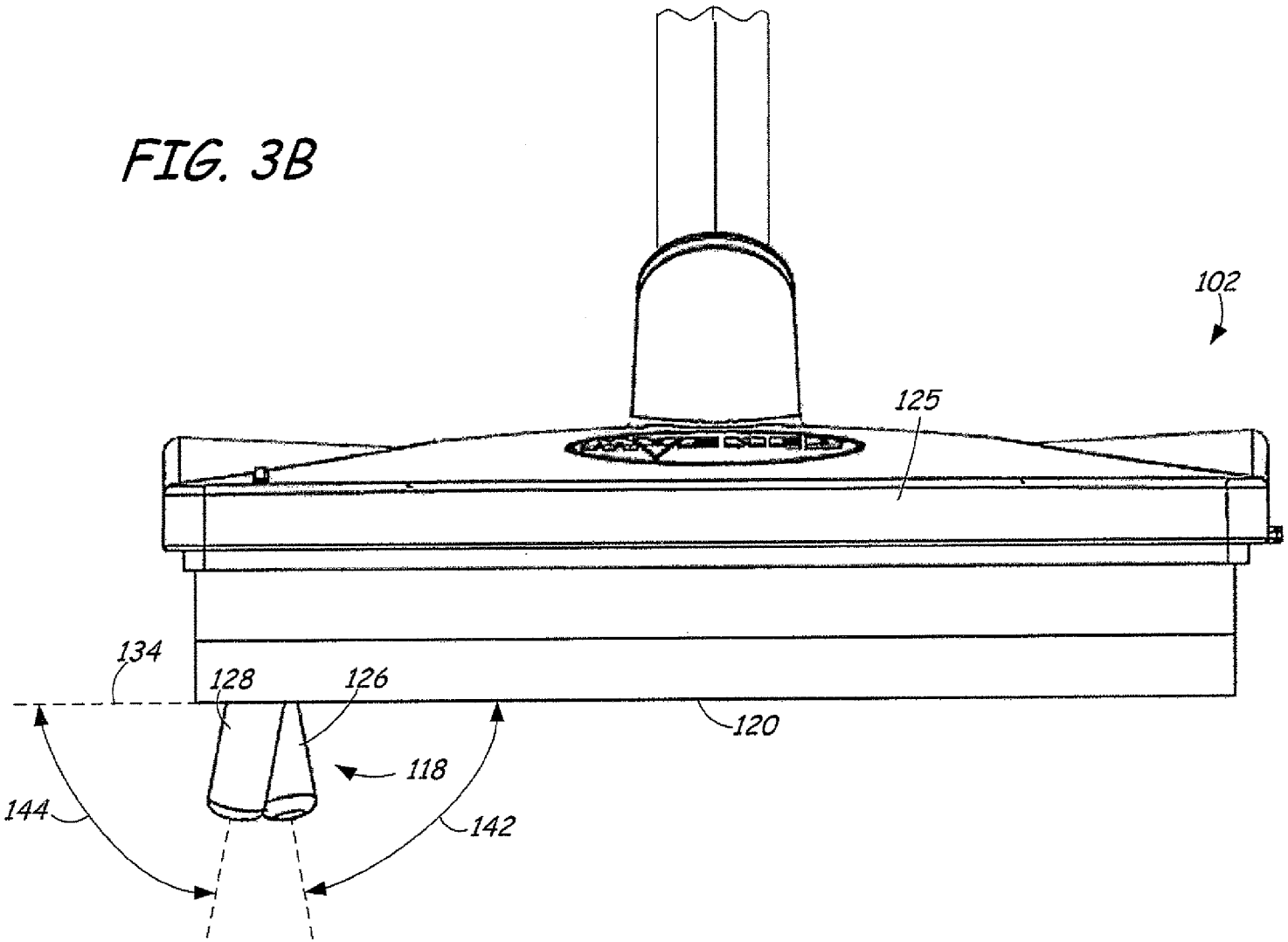

In the embodiment illustrated in FIG. 2, implement 118 is positioned proximate an end 124 of head assembly 102. FIGS. 3A and 3B are side views of head assembly 102 taken from sides 124 and 125, respectively.

In one embodiment, implement 118 comprises a brush or brush-like device. In the illustrated example, implement 118 comprises bristle bundles (illustratively a pair of bristle bundles 126 and 128) that extend in a downward direction from head assembly 102. Each bristle bundle comprises a group of bristles that are connected at one end to head assembly 102. Bristle bundle 126 is attached at a connection point generally illustrated by arrow 130 and bristle bundle 128 is attached at a connection point generally illustrated by arrow 136. In one embodiment, bristle bundles 126 and 128 are separated in a first direction by a distance 140 (FIG. 3A) and in a second direction by a distance 146 (FIG. 2). In one particular embodiment, distances 140 and 146 are approximately 0.70 inches and 0.25 inches, respectively.

In one embodiment, bristle bundles 126 and 128 are angled (e.g., not orthogonal) with respect to a plane (illustrated by dashed line 134) of applicator surface 120. In the illustrated example, each of bristle bundles 126 and 128 are angled with respect to plane 134 in at least two directions. The first bristle bundle 126 extends toward the second bristle bundle 128 at an angle 132 with respect to plane 134 and the second bristle bundle 128 extends toward the first bristle bundle 126 at an angle 138 with respect to plane 134. In one embodiment, each of angles 132 and 138 are approximately 65 to 70 degrees. However, it is understood that other angles 132 and 138 between 0 and 180 degrees can be utilized and that angles 132 and 138 can be equal to or differ from each other. Further, as illustrated in FIG. 3B (which is oriented 90 degrees with respect to the view shown in FIG. 3A) the first bristle bundle 126 has an angle 142 in a second direction. Similarly, the second bristle bundle 128 is oriented at an angle 144. In one embodiment, each of angles 142 and 144 are approximately 75 to 80 degrees. However, it is understood that other angles 142 and 144 between 0 and 180 degrees can be utilized and that angles 142 and 144 can be equal to or differ from each other.

Figure 4:
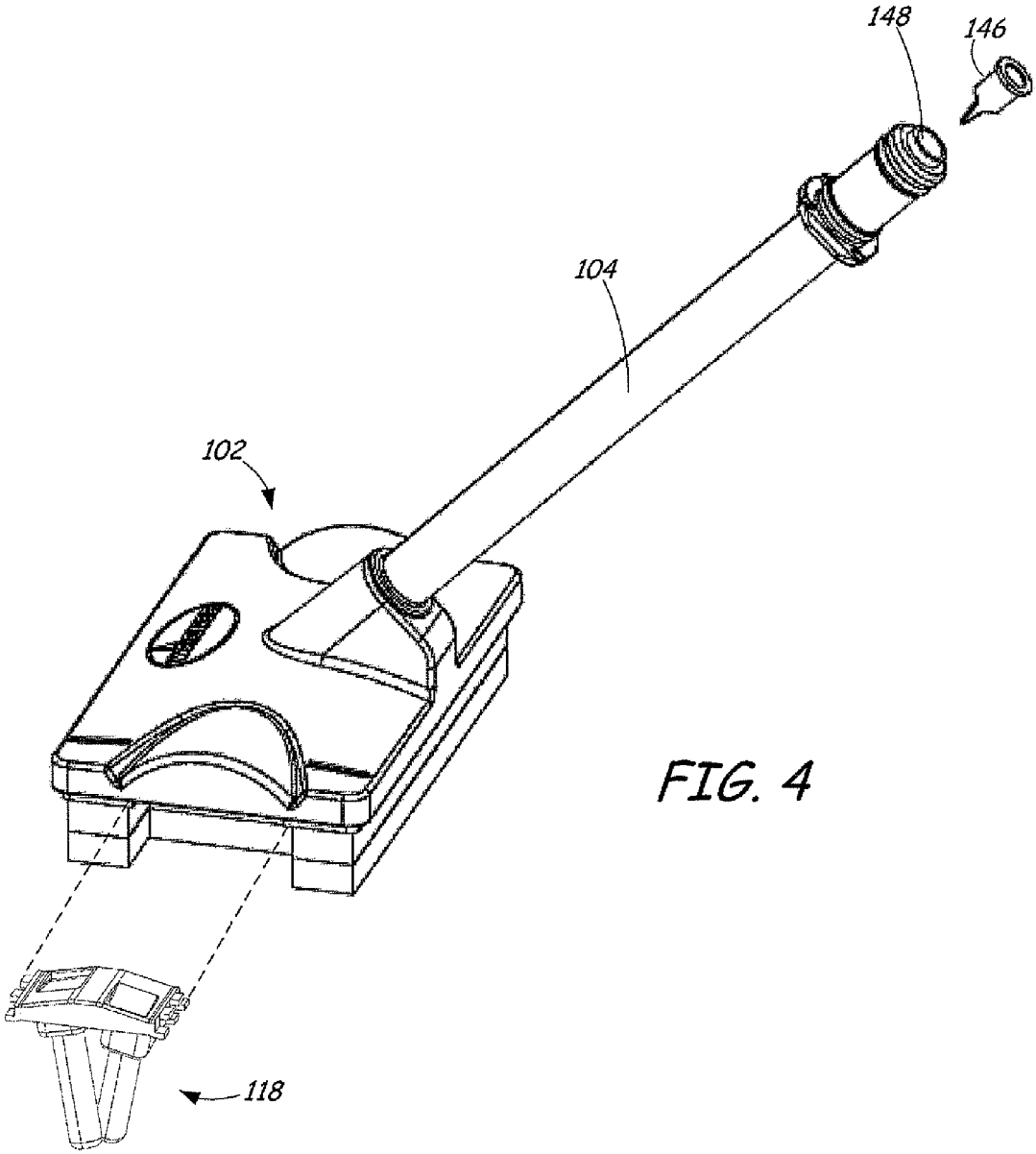
FIG. 4 is a perspective view of a deck stain applicator having a removable implement, under one embodiment.

Over time, use of applicator 100 can cause implement 118 of head assembly 102 to become worn and/or damaged. As illustrated in FIG. 4, in one embodiment implement 118 is removably coupleable to head assembly 102 such that implement 118 can be replaced, as desired. In this manner, when the bristles of implement 118 become worn to some extent, implement 118 can be replaced with a new part. Alternatively, or in addition, implement 118 can be removed and replaced with a different type of tool and/or a tool having a different bristle configuration, for example. For instance, implement 118 can be replaced by a user based on the desired coating application. For example, a user can select a tool for use in applicator 100 based on, but not limited to, the type of coating material, the material type of the surface to be coated, the distance between opposed surface to be coated (i.e., the width of the gaps between boards of a deck to be coated), etc. Alternatively, or in additional, implement 118 can include other types of tools such as, but not limited to, rollers, wheels, guide mechanisms, scrapers, foam pads, to name a few. In one embodiment, implement 118 can be removed and applicator 100 used without an implement or tool 118 attached thereto.

Coating material is provided to head assembly 102 along a path formed through shaft 104. In one embodiment illustrated in FIG. 4, a valve 146 is provided within an aperture 148 of shaft 104 for controlling the flow of the coating material. For example, valve 146 can be glued or otherwise adhered to shaft 104 at aperture 148. In one embodiment, valve 146 comprises a duckbill valve.

Figure 5A:
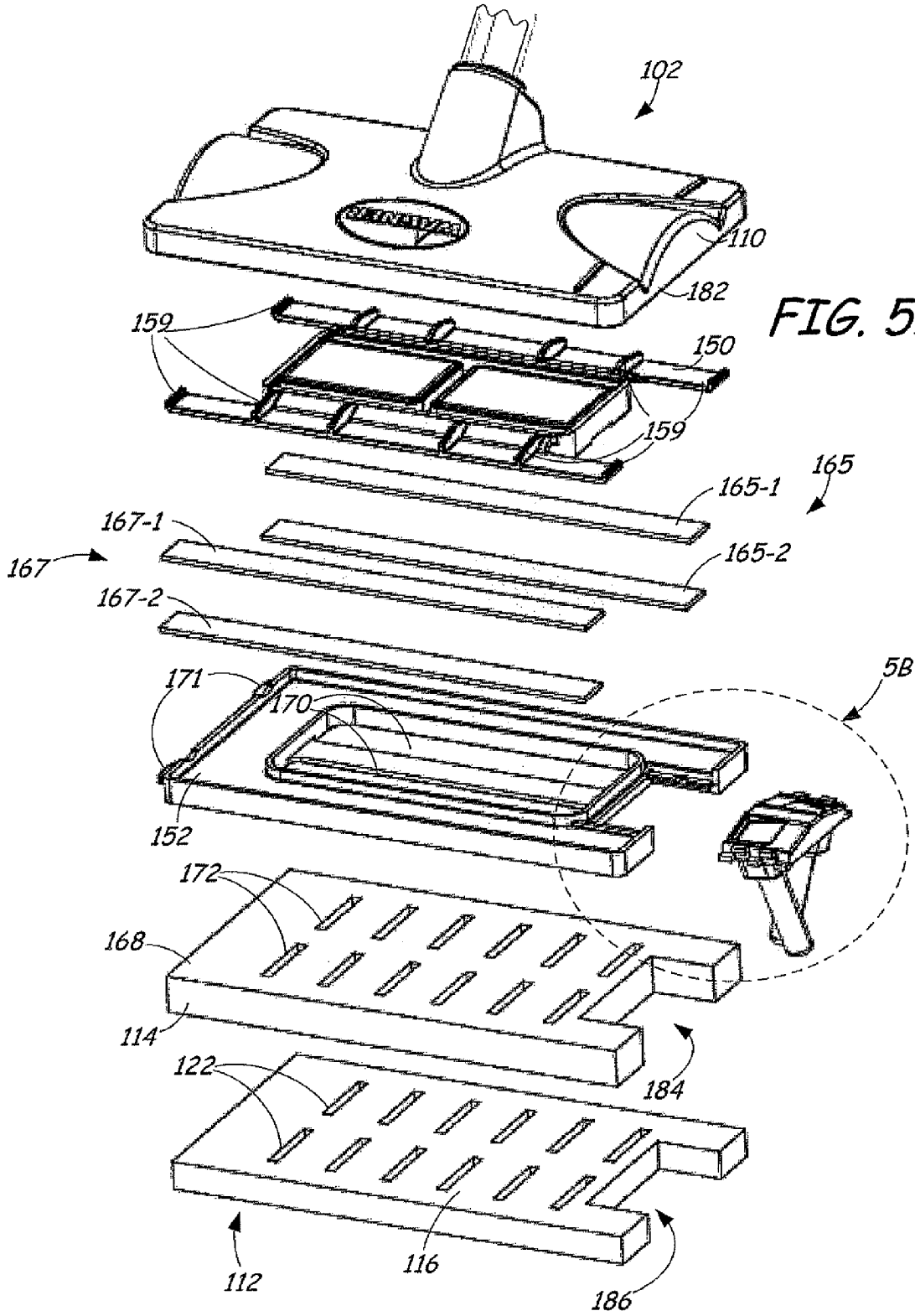
FIG. 5A is an exploded view of a deck stain applicator, under one embodiment.
Figure 5B:
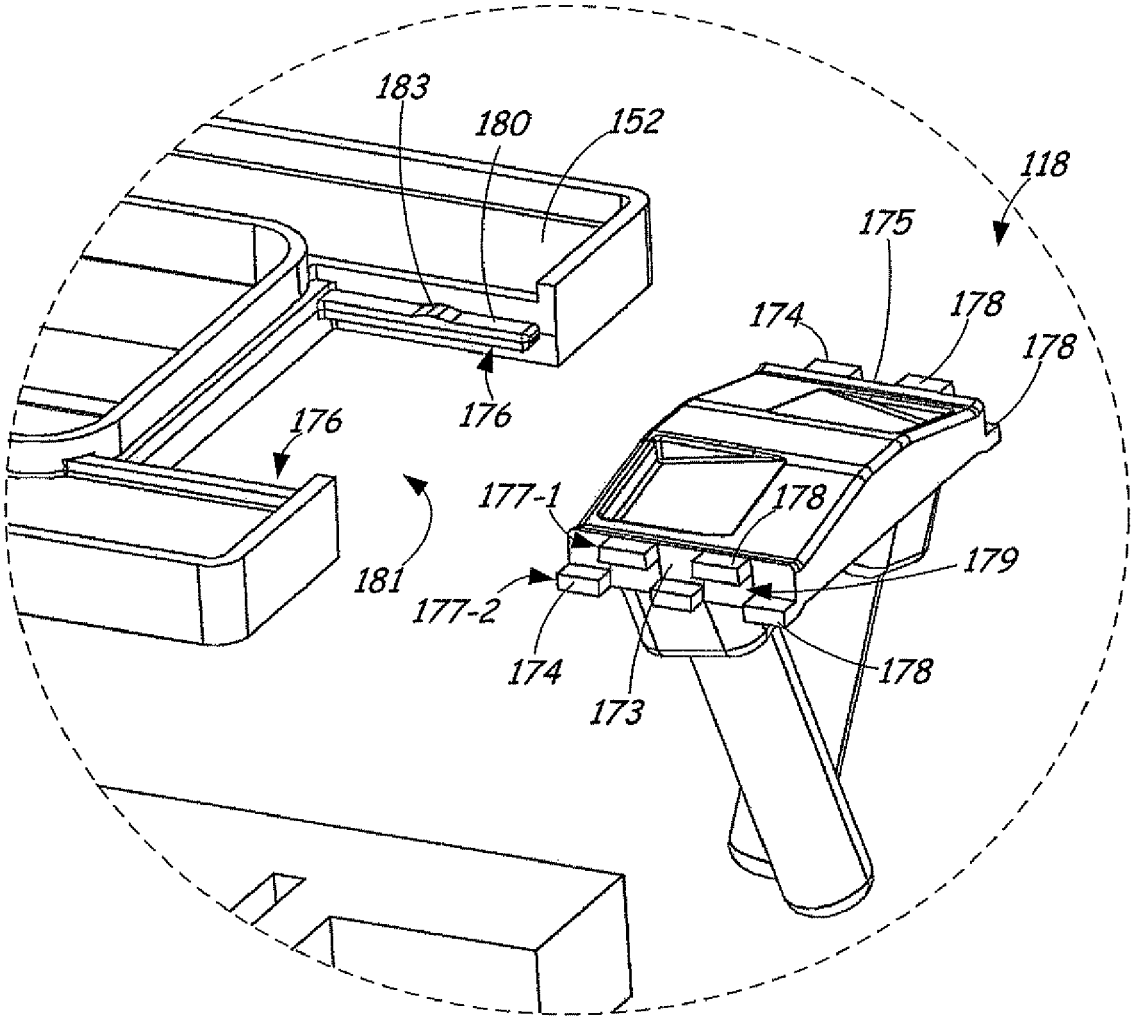
FIG. 5B is an enlarged view of a portion of the deck stain applicator illustrated in FIG. 5A.

FIG. 5A is an exploded view of applicator head assembly 102. FIG. 5B is an enlarged view of a portion (illustrated in FIG. 5A by dashed line "5B") of applicator head assembly 102. As shown, head assembly 102 includes cover 110 and a dispensing layer 150 configured to disperse the coating material provided from cover 110 across base plate assembly 112. In one embodiment, head assembly 102 also includes a spacer layer 152 positioned between dispensing layer 150 and base plate layer 112.

Figure 6:
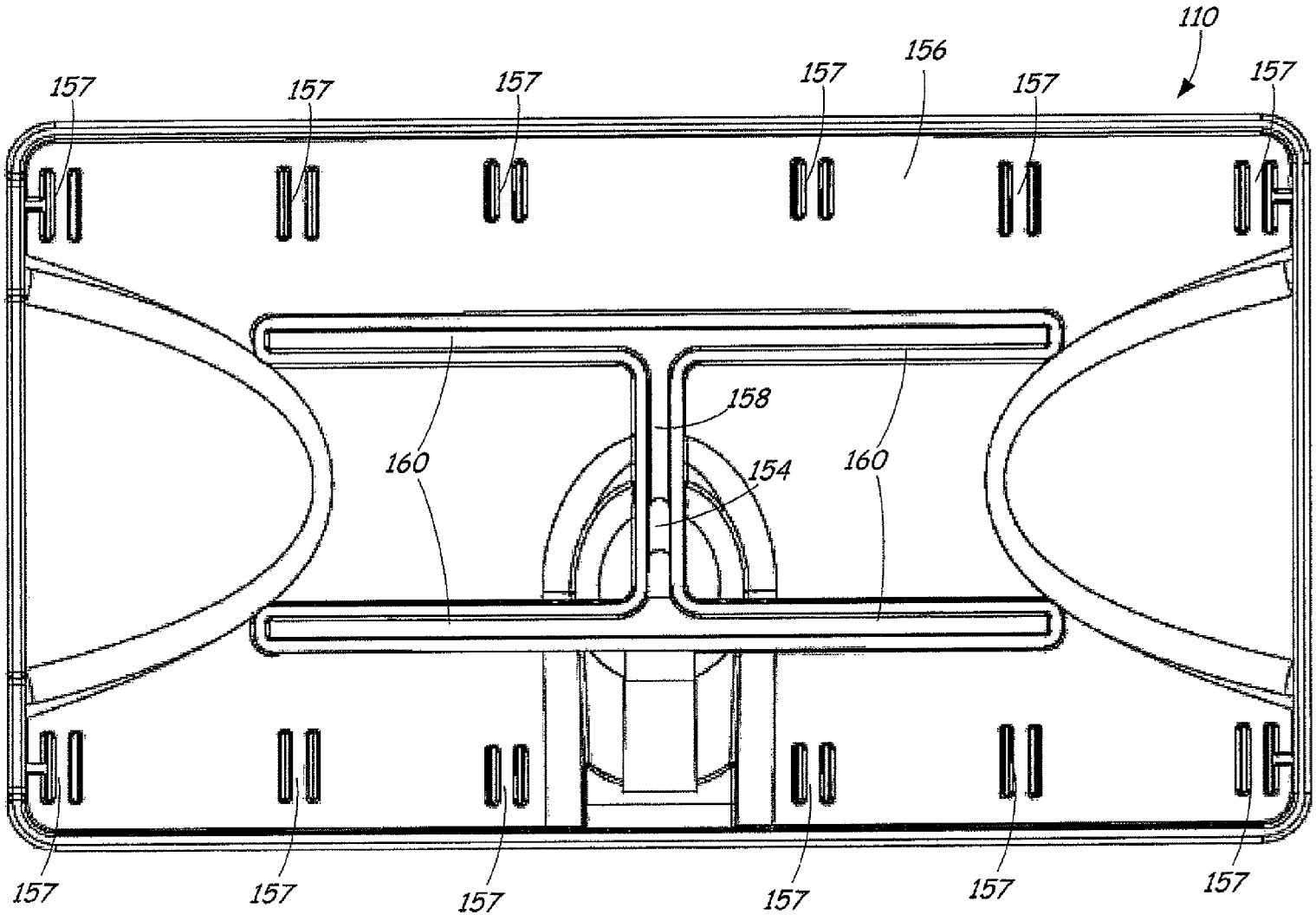
FIG. 6 is a bottom view of a cover of a deck stain applicator, under one embodiment.

FIG. 6 is a bottom view of cover 110. As illustrated, cover 110 includes a port 154 through which the coating material is supplied from a source (i.e., through shaft 104 illustrated in FIG. 4). In the illustrated embodiment, port 154 comprises a single opening through which the coating material is provided. However, in other embodiments port 154 can comprise multiple openings. The bottom surface 156 of cover 110 includes one or more channels for providing the coating material to dispensing layer 150. In the illustrated embodiment, cover 110 includes a main channel 158 (which houses port 154) and a plurality of auxiliary channels or channel extensions 160. Channels 158 and 160 are configured to mate with corresponding channels formed in dispensing layer 150. Further, cover 110 can include a plurality of elements 157 for aligning and/or securing dispensing layer 150 thereto. For example, each of elements 157 can comprise a pair of raised protrusions (e.g., ridges or ribs) that are configured to receive a corresponding protrusion (e.g., ridge or rib) 159 (shown in FIGS. 5A and 7) of dispensing layer 150 therebetween, thereby aligning layer 150 with respect to cover 110. Alternatively, or in addition, elements 157 and 159 can comprise fastening mechanisms (such as snap fit joints, and the like) for securing layer 150 to cover 110.

Figure 7:
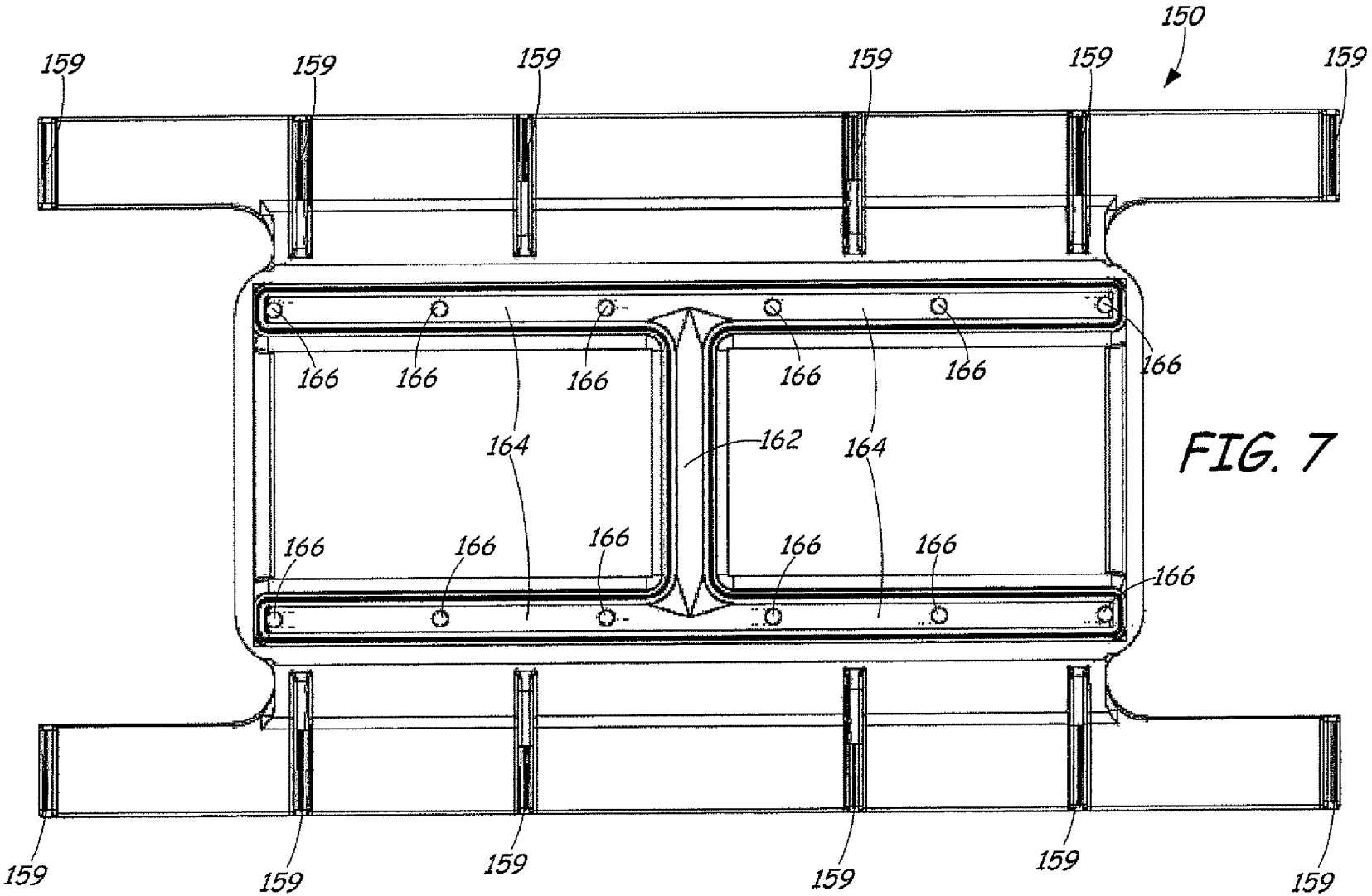
FIG. 7 is a top view of a fluid dispensing layer of a deck stain applicator, under one embodiment.

FIG. 7 is a top view of dispensing layer 150, under one embodiment. As illustrated, dispensing layer 150 includes a corresponding main channel 162 and a plurality of auxiliary channels or channel extensions 164. The channels form a path for the coating material provided from port 154 to flow to ports 166 formed through dispensing layer 150. The coating material passes through ports 166 and is delivered to a top surface 168 (see FIG. 5) of the first base plate layer 114 of base plate assembly 112. As illustrated in FIG. 5, spacer layer 152 can include apertures 170 formed to accommodate the flow of the coating material from ports 166 to base plate assembly 112.

In accordance with one embodiment, base plate layer 114 includes a plurality of orifices 172 formed therethrough that enable the coating material to pass through base plate layer 114. In accordance with one embodiment, each orifice 172 is aligned (i.e., vertically aligned) with a corresponding port 166 of dispensing layer 150. Orifices 172 can comprise elongated holes or slots, for example.

The second base plate layer 116 of base plate assembly 112 includes orifices 122 (also illustrated in FIG. 2) that are aligned with orifices 172 formed in base plate layer 114. In accordance with one embodiment, orifices 122 have a similar cross-sectional area as compared to orifices 172. In another embodiment, orifices 122 can have larger or smaller cross-sections than orifices 172. Base plate layers 114 and 116 can comprise absorbent, semi-absorbent, and/or non-absorbent materials, depending on the desired application. For example, one or more of base plate layers 114 and 116 can comprise rubber, plastic, foam, and/or sponge-like materials, to name a few.

Head assembly 102 can also include fasteners for securing some or all of the layers (e.g., dispensing layer 150, spacer layer 152, and/or base plate layer 112) to one another. For example, in the embodiment illustrated in FIG. 5A head assembly 102 includes a pair of fasteners 165 and 167 that are configured to removably attach spacer layer 152 to dispensing layer 150. Fastener 165 includes a first portion 165-1 that is attached to dispensing layer 150 and a second portion 165-2 that is attached to spacer layer 152. Portions 165-1 and 165-2 can be fixedly attached to their respective layers using an adhesive, for example. Similarly, fastener 167 includes a first portion 167-1 that is attached to dispensing layer 150 and a second portion 167-2 that is attached to spacer layer 152. Portions 167-1 and 167-2 can be fixedly attached to their respective layers using an adhesive, for example. In one embodiment, each of fasteners 165 and 167 comprise corresponding hook and loop strips (although other types of fasteners can be utilized). In one embodiment, each of fasteners 165 and 167 is configured such that spacer layer 152 and dispensing layer 150 can only be assembled in one orientation (i.e., spacer layer 152 cannot be reversed with respect to dispensing layer 150. For example, fasteners 165 and 167 can be configured such that strip 165-2 does not adhere to strip 167-1 and strip 167-2 does not adhere to strip 165-1. Alternatively, or in addition, spacer layer 152 can include protrusions 171 that are configured to engage a portion of cover 110 for securing layer 152 to cover 110.

Removable implement 118 comprises connection mechanisms 174 that are configured to engage corresponding connection mechanisms 176 formed on spacer layer 152. For example, in the illustrated embodiment removable implement 118 includes a first connection mechanism 174 on a first side 173 of implement 118 and a second connection mechanism 174 on a second, opposite side 175 of implement 118. Each of mechanisms 174 includes one or more protrusions 178 that are configured to receive the connection mechanisms 176 (illustratively rails 180) formed on spacer layer 152. In one embodiment, rails 180 are formed along a recess 181 of spacer layer 152.

In the illustrated embodiment, implement 118 connects and disconnects from spacer layer 152 by sliding connection mechanisms 174 along rails 180. In one embodiment, when implement 118 is connected to layer 152, a surface 182 of cover 110 prevents implement 118 from accidental disengagement from spacer layer 152, for example during use. Spacer layer 152 is separated from cover 110 before implement 118 is removed from spacer layer 152.

In one embodiment, each connection mechanism 174 comprises a plurality of protrusions 178 that are separated by a gap 179 that is configured to receive one of rails 180. For example, a first row 177-1 of protrusions 178 (or alternately a single protrusion forming a rail along a length of implement 118, for example) is separated a distance from a second row 177-2 of protrusions 178 (or alternately a single protrusion forming a rail along a length of implement 118, for example).

In one embodiment, each of rails 180 of spacer layer 152 can include a protrusion or ridge 183 that is configured to retain implement 118 on spacer layer 152. For example, a protrusion 183 of each rail 180 is retained between two or more of protrusions 178 when implement 118 slid onto layer 152.

In accordance with one embodiment, each of base plate layers 114 and 116 comprise recesses 184 and 186, respectively, formed therein. Recesses 184 and 186 are configured to accommodate the bristle bundles of implement 118.

FIG. 8 is an exploded view of implement 118. As shown, the first bristle bundle 126 is attached to a base 188 using a first collar 190. Collar 190 includes an aperture 192 formed therein and is attached to a recess 194 formed in base 188. In one example, collar 190 attaches to base 188 using an adhesive. In another example, collar 190 attaches to base 188 using a snap fastener mechanism. An adhesive can also be utilized to secure bristle bundle 126 to collar 190 and/or base 188. Similarly, the second bristle bundle 128 is secured to base 188 using a second collar 196. Collar 196 includes an aperture 198 formed therein and is attached to a recess 199 formed in base 188. In one example, collar 196 attaches to base 188 using an adhesive. In another example, collar 196 attaches to base 188 using a snap fastener mechanism. An adhesive can also be utilized to secure bristle bundle 128 to collar 196 and/or base 188.

While various embodiments of the invention have been set forth in the foregoing description, together with details of the structure and function of various embodiments of the disclosure, this disclosure is illustrative only, and changes may be made in detail, especially in matters of structure and arrangement of parts within the principles of the present disclosure to the full extent indicated by the broad general meaning of the terms in which the appended claims are expressed. For example, the particular elements may vary depending on the particular application for the system or method while maintaining substantially the same functionality without departing from the scope and spirit of the present disclosure and/or the appended claims.

What is claimed:

1. A coating material applicator configured to apply a coating material to a structure having a generally planar surface formed by members having opposed surfaces separated by one or more gaps, the coating material applicator comprising:

a top cover;

a base layer having an applicator surface for applying a coating material to the generally planar surface;

a removable implement for applying the coating material to the opposed surfaces; and a layer having at least one connection mechanism configured to receive at least one corresponding connection mechanism of the removable implement, wherein the layer having the at least one connection mechanism is disposed between the top cover and the base layer.

2. The coating material applicator of claim 1, wherein the removable implement comprises bristles extending beyond a plane defined by the applicator surface.

3. The coating material applicator of claim 2, wherein the removable implement comprises at least one bristle bundle, each having a plurality of bristles.

4. The coating material applicator of claim 3, wherein the removable implement comprises a base and a pair of bristle bundles secured to the base.

5. The coating material applicator of claim 4, wherein each bristle bundle is secured to the base using a collar.

6. The coating material applicator of claim 4, wherein a first bristle bundle is attached to the base at a first connection point and the second bristle bundle is attached to the base at a second connection point, the first and second connection points being spaced apart along the base.

7. The coating material applicator of claim 6, wherein the first bristle bundle extends from the first connection point toward the second bristle bundle.

8. The coating material applicator of claim 7, wherein the second bristle bundle extends from the second connection point toward the first bristle bundle.

9. The coating material applicator of claim 1, wherein the layer having the at least one connection mechanism comprises a coating material dispensing layer.

10. The coating material applicator of claim 1, wherein the layer having the at least one connection mechanism comprises a spacer layer.

11. The coating material applicator of claim 10, and further comprising a coating material dispensing layer disposed between the spacer layer and the cover.

12. The coating material applicator of claim 1, wherein the layer having the at least one connection mechanism is removably coupled to the top cover.

13. The coating material applicator of claim 1, wherein the top cover is coupled to an elongate shaft.

14. The coating material applicator of claim 13, wherein the shaft comprises an internal fed mechanism configured to supply a flow of coating material to the base layer.

15. A coating material applicator configured to apply a coating material to a structure having a generally planar surface formed by members having opposed surfaces separated by one or more gaps, the coating material applicator comprising:

a base layer having an applicator surface for applying a coating material to the generally planar surface;

a removable implement for applying the coating material to the opposed surfaces; and a layer having at least one connection mechanism comprising a pair of rails that are configured to receive a corresponding connection mechanism of the removable implement.

16. The coating material applicator of claim 15, wherein the corresponding connection mechanism of the removable implement comprises a plurality of protrusions that are spaced apart to define a gap, wherein the gap is configured to receive at least one of the pairs of rails.

17. The coating material applicator of claim 15, wherein the layer having the at least one connection mechanism is disposed between a top cover and the base layer.

18. A coating material applicator configured to apply a coating material to a structure having a generally planar surface formed by members having opposed surfaces separated by one or more gaps, the coating material applicator comprising:

a base layer having an applicator surface for applying a coating material to the generally planar surface;

a removable implement for applying the coating material to the opposed surfaces; and a layer having at least one connection mechanism configured to receive at least one corresponding connection mechanism of the removable implement, wherein the removable implement is removable from the layer having the at least one connection mechanism in a direction substantially parallel to the generally planar surface of the base layer.

19. The coating material applicator of claim 18, wherein a portion of the top cover is configured to engage and prevent removal of the removable implement from the connection mechanism.

20. The coating material applicator of claim 18, wherein the layer having the at least one connection mechanism is disposed between a top cover and the base layer.

* * * * *